United States Patent [19]

Myers

[11] Patent Number: 4,483,663

[45] Date of Patent: Nov. 20, 1984

[54] OUTPUT SPEED DROOP COMPENSATING PUMP CONTROL

[75] Inventor: H. Allen Myers, Ames, Iowa

[73] Assignee: Sundstrand Corporation, Rockford, Ill.

[21] Appl. No.: 410,370

[22] Filed: Aug. 23, 1982

[51] Int. Cl.[3] ..... F04B 1/26

[52] U.S. Cl. ..... 417/222; 60/391; 60/444; 60/452

[58] Field of Search ..... 60/443, 444, 445, 448, 60/451, 452, 465, 391; 417/218, 222

[56] References Cited

U.S. PATENT DOCUMENTS

| | | | |
|---|---|---|---|
| 3,319,419 | 5/1967 | Hann | 60/452 X |
| 3,854,847 | 12/1974 | Schlecht | 417/212 |
| 3,941,514 | 3/1976 | Louis et al. | 417/222 X |
| 4,050,247 | 9/1977 | Connett | 60/444 |
| 4,381,702 | 5/1983 | Myers | 417/222 X |
| 4,399,886 | 8/1983 | Pollman | 60/445 X |

*Primary Examiner*—Edward K. Look
*Attorney, Agent, or Firm*—Wood, Dalton, Phillips, Mason & Rowe

[57] ABSTRACT

The output speed droop compensating control is associated with a variable displacement pump connected to a motor in a fluid system. The pump has a swash plate urged in one direction by a hydraulic fluid pressure moment acting through the pistons of the pump and a servo control cylinder having a control piston connected to the swash plate. The control includes a control valve connected to the control cylinder and having a set position for maintaining a fluid pressure in the control cylinder to set the position of the swash plate for a particular pump displacement. The control valve is movable from the set position to adjust the position of the swash plate by connection of the control cylinder to either control pressure or drain. The control valve includes a valve spool which responds, when the control valve is in set position to an increase in pressure in the control cylinder responsive to the swash plate being urged in one direction by said fluid pressure moment to shift the valve spool and connect the control cylinder to control pressure and thereby modify the position of the swash plate to cancel the effect of leakage at a higher system pressure. A feedback linkage is connected between the swash plate and the valve spool and includes a spring providing a yieldable connection whereby the valve spool can shift in response to the increase of pressure in the control cylinder.

12 Claims, 1 Drawing Figure

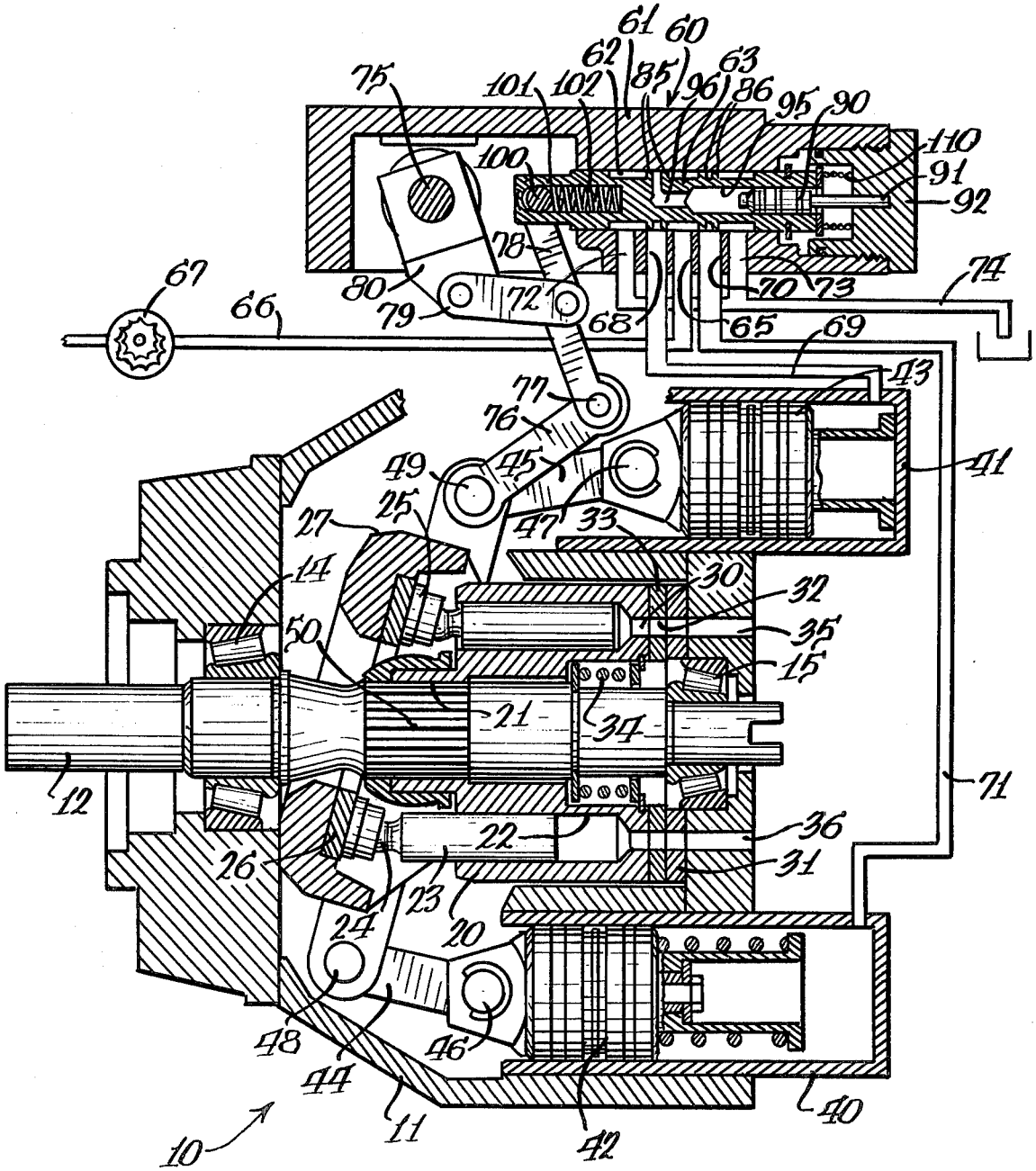
61
60
62
63
75
101
102
85
96
86
95
90
110
100
91
92
78
67
80
72
70
73
74
66
79
68
65
69
43
77
76
41
49
45
27
25
47
33
14
30
32
50
35
15
21
34
12
71
22
36
26
31
23
24
20
48
46
44
11
42
40
10

OUTPUT SPEED DROOP COMPENSATING PUMP CONTROL

TECHNICAL FIELD

This invention relates to a control for a variable displacement pump to compensate for speed droop in the speed output of a transmission when caused to operate under increased load and having a motor connected to the pump. More particularly, the control responds to an increase in pressure in the servo control system for the swash plate of the variable displacement pump which occurs as a result of a hydraulic fluid pressure moment acting on the swash plate through the pistons of the pump when system pressure increases because of increased load on the transmission.

BACKGROUND ART

It has been recognized that there can be a droop in the output speed in a hydrostatic or hydromechanical transmission having a variable displacement pump supplying fluid to a fixed displacement motor when the fluid system pressure increases because of an increased load on the transmission. This droop results because an increase of pressure in the fluid system results in an increase in system flow leakage whereby the motor effectively operates with less fluid with the pump at a particular displacement. It is known to eliminate this speed droop by use of complex and costly electronic controls wherein the actual output speed of the transmission is detected and any deviation from the desired speed results in a modification of the displacement of the variable displacement pump.

DISCLOSURE OF THE INVENTION

This invention pertains to an output speed droop compensating control for a variable displacement pump which is connected to a motor in a fluid system, such as a hydrostatic transmission and wherein the hydrostatic transmission is connected directly to a load or is a component of a hydromechanical transmission. The control provides for adjustment of pump displacement to maintain substantially constant transmission output speed independent of load on the transmission.

An object of the invention is to provide a speed droop compensating control for a variable displacement pump connected to a motor in a hydrostatic transmission driving an output shaft or forming part of a hydromechanical transmission wherein a hydraulic pressure moment resulting from an increase in system pressure because of an increased load on the output of the transmission urges the swash plate of the pump to move in a direction to increase the pressure in a servo control cylinder associated with the swash plate. The increase in pressure is utilized to shift a servo control valve to cause adjustment of the swash plate to change the pump displacement and maintain the output speed of the transmission constant.

Another object of the invention is to provide a control of the type described in the preceding paragraph which is accomplished by minimal modifications to standard pump control components and association of minimal additional structure therewith to result in a low-cost reliable control.

Still another object of the invention is to provide a control for a variable displacement pump to compensate for speed droop of a motor connected to the pump when operated under increased load, the pump having a swash plate urged in one direction by a hydraulic fluid pressure moment acting through the pistons of the pump and a control cylinder having a control piston connected to said swash plate, said control comprising, a control valve having a set position for maintaining a fluid pressure in said control cylinder to set the position of the swash plate and movable from the set position to adjust the position of the swash plate by connection of the control cylinder to either control pressure or drain, means responsive to an increase in pressure in the control cylinder responsive to said swash plate being urged in said one direction by said fluid pressure moment to shift said control valve from said set position to connect the control cylinder to control pressure to move the swash plate in a direction opposite said one direction, and feedback linkage between said control valve and swash plate.

BRIEF DESCRIPTION OF THE DRAWING

The FIGURE is a central, vertical section through a variable displacement pump and the output speed droop control associated therewith and showing a connection to a source of control pressure.

BEST MODE FOR CARRYING OUT THE INVENTION

A variable displacement pump is indicated at 10 and has a housing 11, shown fragmentarily, which rotatably mounts a drive shaft 12 journalled in bearings 14 and 15. A cylinder block 20 is splined to the drive shaft 12 at 21 and has a plurality of cylinders 22 equally spaced around the axis of rotation of the cylinder block and with their longitudinal axes symmetrical and generally parallel about the axis of rotation. A plurality of pistons 23 are movably positioned, one in each of the cylinders, and each have an end extending outwardly of the cylinders with a ball-shaped end 24 pivotally seated in a bearing shoe 25 suitably retained in association with a thrust plate 26 associated with a swash plate 27.

The inner ends of the cylinders 22 each have a passage 30 communicating with a valve plate 31 through passages 32 in a bearing plate 33. A spring 34 urges the cylinder block 20 toward the valve plate 31.

A pair of ports 35 and 36 in the housing are connectable to the lines leading to a fluid motor to complete the hydrostatic transmission, with the motor preferably being an axial piston unit of fixed displacement.

The variable displacement pump 10 can operate at either side of a neutral position, with the swash plate being rotatable about an axis defined by trunnions (not shown) which pivotally mount the swash plate. The position of the swash plate is controlled by a servo system including a pair of control cylinders 40 and 41 having pistons 42 and 43, respectively. The pistons 42 and 43 are connected to the swash plate through links 44 and 45, respectively, which, at one of their ends, are pivotally connected to the pistons, as shown at 46 and 47, and, at their other ends, are pivotally connected to the swash plate, as indicated at 48 and 49. The swash plate 27 is shown in the drawing in a maximum displacement position wherein the control piston 42 in the control cylinder 40 is in a fully advanced position and the control piston 43 in the control cylinder 41 is in a fully retracted position.

The structure of the variable displacement axial piston pump thus far described is conventional and known in the art as, for example, shown in the Hann et al U.S.

Pat. No. 3,359,727. The Hann et al patent shows the pump in circuit with a fixed displacement motor to define a fluid system and, more particularly, a hydrostatic transmission wherein the ports of the pump and motor are interconnected for fluid flow therebetween. The disclosure of the Hann et al patent is incorporated herein by reference.

The hydrostatic transmission can be used with the pump connected to a prime mover and the motor thereof connected to an output shaft for driving a load, such as the wheels of an automotive vehicle. The hydrostatic transmission may also be a component of a hydromechanical transmission wherein planetary gearing is associated with the prime mover, the hydrostatic transmission and the output shaft, with an example of such hydromechanical transmission being shown in the Ross U.S. Pat. No. 3,396,607 and the disclosure thereof being incorporated herein by reference.

In either a hydrostatic transmission or a hydromechanical transmission, there can be an increase in system pressure in the lines between the pump and motor when there is increased loading on the output shaft of the transmission. This results in inherent increase in leakage within the transmission which is proportional to the increase in system pressure.

The invention disclosed herein senses the increase in system pressure and automatically adjusts the position of the swash plate to a displacement which effectively causes the output speed of the transmission to remain substantially constant. The output speed droop compensating control relies upon a hydraulic fluid pressure moment acting on the swash plate 27 through the pistons 23 which is proportional to system pressure. The swash plate 27 has a pivot axis located generally as indicated at 50 whereby the hydraulic pressure moment acting through the pistons tends to rotate the swash plate 27 in a clockwise direction as viewed in the drawing. The pressure in control cylinder 41 must overcome this moment as well as piston inertia caused moments. The cylinder 40 has a centering spring but a similar spring is omitted from cylinder 41 to ensure that net swash plate moment is always clockwise.

A thorough discussion of the hydraulic pressure moment action on a swash plate is contained in the Hann et al U.S. Pat. No. 3,230,893. With the swash plate positioned between a neutral position and the maximum displacement position, shown in the drawing, these moments urge the swash plate toward the maximum displacement position. When the swash plate is positioned counterclockwise of a neutral position, the moment urges the swash plate toward the neutral position. In either of these instances, when the hydrostatic transmission is part of a hydromechanical transmission, the moment urges the swash plate toward a position reducing output speed of the transmission.

A control valve, indicated generally at 60 has a body 61 with a bore 62 which movably mounts a valve spool 63. The valve body has a number of ports communicating with the bore 62 including a port 65 which connects through a line 66 to a source of control pressure, such as a charge pump 67, which is connected to a drive input, such as the prime mover which drives the pump shaft 12. A control port 68 communicates the bore 62 with an end of the control cylinder 41 through a line 69. A control port 70 communicates the bore with an end of the control cylinder 40 through a line 71. A pair of drain ports 72 and 73 connect the bore with drain through a line 74.

In normal control of the displacement of the variable displacement pump, the valve spool 63 is moved to effect an adjustment in the position of the swash plate. This movement of the valve spool from the set position shown results in connecting one of the control ports 68 and 70 to the source of control pressure and the other port to drain. This action of the valve spool is derived from rotation of an input shaft 75 by a handle or other suitable means which operates through a feedback linkage. This linkage includes a link 76 pivotally connected to the swash plate at 49 and pivotally connected at 77 to a link 78 which extends to a connection to the valve spool 63 and a link 79 which is pivotally connected at its opposite ends to an arm 80 associated with the input shaft 75 and to the link 78 intermediate its ends. The feedback linkage operates to return the valve spool to the set position as the swash plate moves to an adjusted position. In the set position of the valve spool, a first pair of lands 85, separated by a peripheral groove on the exterior of the valve spool 63, block the control port 68 from communication with either the control pressure port or a drain port. This maintains a set control pressure in the control cylinder 41. A second pair of lands 86 on the exterior of the valve spool are positioned to permit the control port 70 to communicate with the drain port 73.

The valve body mounts a servo pressure sensing piston 90 held in position on a stem 91 fitted into a cap 92 threaded into the end of the valve body, with the piston being received in a bore 95 in the valve spool and with the valve spool being movable relative to the piston 90. In the set position of the valve spool, the valve spool bore 95 communicates with the control port 68 through a passage 96 leading to the peripheral groove between lands 85.

When the fluid system pressure increases, the hydraulic fluid pressure moment acting through the pistons 23 of the pump urges the swash plate clockwise, as viewed in the drawing (when the swash plate is other than at the maximum displacement position shown), with the result that the piston 43 causes an increase in pressure in the control cylinder 41. This increase in pressure is effective within the valve spool bore 95 through the passage 96, with the result that the valve spool is caused to shift to the left as viewed in the drawing. This shift of the valve spool causes the lands 85 to be positioned, whereby control pressure in port 65 is directed to the control port 68 and through line 69 is delivered to the control cylinder 41 to cause counterclockwise rotation of the swash plate. This counterclockwise rotation acts to increase transmission output speed. This results in eliminating the output speed droop normally occurring due to system flow leakage when swash plate angle is held constant and system pressure increases.

The valve spool 63 is free to move to the left, as viewed in the drawing, in response to an increase in pressure in the valve spool bore 95 because of a yieldable connection of the feedback linkage to the valve spool. More particularly, an end of the feedback link 78 has a pin 100 movable within a slot 101 in an end of the valve spool and with a compression spring 102 mounted within the slot and urging the valve spool toward the right. Thus, the initial movement of the valve spool 63 toward the left results in a compression of the spring 102 and without any movement of the feedback linkage. As the swash plate rotates counterclockwise toward its new set position, it rotates the link 78 clockwise, moving the pin 100 to the right and acting through the spring 102 the valve spool is moved to the right to return the valve spool to set position.

A spring 110 acts against the right-hand end of the spool 63 to provide a small amount of force urging the valve spool toward the left, as viewed in the drawing.

With the invention disclosed herein, substantially constant transmission output speed is maintained and made independent of transmission load. The hydraulic fluid pressure moments urge the swash plate toward a position reducing output speed of the transmission. This results in an increase in pressure within the bore of the valve spool to cause a movement thereof to resultingly shift the swash plate in the proper direction to cancel the effect of high pressure leakage on hydraulic motor speed resulting from increased load. The pump displacement is increased when the pump is in a driving mode and is decreased when it is in a braking mode. In the system shown, the speed droop control functions for high pressure on only one side of the pump which can be when the pump is either driving or braking. It is possible to have a system which functions for high pressure on either side of the pump and this could be accomplished by making the piston 90 react to the differential between the pressures in the control cylinders 40 and 41 and by having the spring 102 function in both tension and compression.

With the control as shown, the proper amount of correction may be determined empirically, with the variables being the diameter of the bore 95 in the valve spool and the rate of the spring 102.

INDUSTRIAL APPLICABILITY

With the output speed droop compensating control for a pump, it is possible to utilize only slightly modified standard components and minimal additional structure to maintain a transmission output speed constant even when the load on the transmission increases.

I claim:

1. A speed droop compensating control for a variable displacement pump connected to a motor in a fluid system, the pump having a swash plate urged in one direction by a hydraulic fluid pressure moment acting through the pistons of the pump and a control cylinder having a control piston connected to said swash plate comprising, a control valve having a set position for maintaining a fluid pressure in said control cylinder to set the position of the swash plate and movable from the set position to adjust the position of the swash plate by connection of the control cylinder to either control pressure or drain, and means responsive to an increase in pressure in the control cylinder responsive to said swash plate being urged in said one direction by said fluid pressure moment to shift said control valve from said set position to connect the control cylinder to control pressure and modify the position of the swash plate to cancel the effect of leakage at a higher system pressure.

2. A control as defined in claim 1 including feedback linkage between said swash plate and control valve, and a spring connection of said linkage to said control valve to enable movement of the control valve from said set position.

3. A control as defined in claim 1 wherein said pressure responsive means includes a control valve spool with a bore, a piston within said bore, and means for communicating control cylinder pressure to said bore.

4. A control as defined in claim 3 wherein said control valve has a body with a control port connected to said control cylinder and pressure and drain ports positioned one at each side of said control port, said means for communicating control pressure to said bore including a passage in said valve spool which aligns with said control port when the control valve is in said set position, and a pair of lands on said valve spool at either side of said passage for blocking said passage from said drain and pressure ports when the control valve is in said set position.

5. A control as defined in claim 1 wherein said pump has a central minimum displacement position and said swash plate is positionable to either side of said central position.

6. A control for a variable displacement pump to compensate for speed droop of a motor connected to the pump when operated under increased load, the pump having a swash plate urged in one direction by a hydraulic fluid pressure moment acting through the pistons of the pump and a control cylinder having a control piston connected to said swash plate, said control comprising, a control valve having a set position for maintaining a fluid pressure in said control cylinder to set the position of the swash plate and movable from the set position to adjust the position of the swash plate by connection of the control cylinder to either control pressure or drain, means responsive to an increase in pressure in the control cylinder responsive to said swash plate being urged in said one direction by said fluid pressure moment to shift said control valve from said set position to connect the control cylinder to control pressure to move the swash plate in a direction opposite said one direction, and feedback linkage between said control valve and swash plate.

7. A control as defined in claim 6 including a spring providing a yieldable connection between said feedback linkage and said control valve.

8. A droop compensating control for a variable displacement pump connectable in a hydrostatic transmission with a motor and having a swash plate urged in one direction by a hydraulic fluid pressure moment acting through the pistons of the pump and a pair of control cylinders each having a control piston connected to said swash plate comprising, a control valve having a position for maintaining a fluid pressure in one of said control cylinders to set the position of the swash plate and movable from said position to adjust the position of the swash plate by connection of said one control cylinder to either control pressure or drain, and means responsive to an increase in pressure in said one control cylinder responsive to said swash plate being urged in said one direction by said fluid pressure moment to shift said control valve from said set position to connect said one control cylinder to control pressure, and feedback linkage including a yieldable connection between said swash plate and said control valve.

9. An output speed droop compensating control for a variable displacement pump supplying fluid to a motor; said pump having a rotatable cylinder block with a plurality of pistons, and a pivotally-mounted swash plate operatively associated with said pistons for controlling the stroke thereof and urged in one direction in response to a moment resulting from forces acting on the pistons proportional to the pressure of the fluid being pumped; a control cylinder having a piston connected to said swash plate; a control valve having a body with a port connectable to a source of fluid at a control pressure, a control port connected to said control cylinder and a port connectable to drain; a valve spool in said control valve body positionable to control communication between said ports whereby the control valve may control the position of the swash plate and apply control pressure fluid to said control cylinder to act on said piston to urge the swash plate in a direction opposite said one direction and having a position to maintain the set position of the swashplate; said valve spool having a bore, a pressure-sensing piston mounted on said control valve body and positioned in said valve spool bore, a passage in said valve spool connecting the exterior of the valve spool with said bore and located to communicate with said control port whereby, with the valve spool in said position, an increase in pressure in the control cylinder acts to move the valve spool in a direction to connect said control port to said control pressure port and shift the swash plate to a position to cancel the effect of increased leakage at an increased pressure of the fluid being pumped.

10. A control as defined in claim 9 including feedback linkage between said swash plate and the valve spool, and a yieldable connection of said linkage to said valve spool to permit movement of the valve spool in response to pressure in said bore.

11. A control as defined in claim 9 including a pair of lands on said valve spool at either side of said passage for blocking said passage from said control pressure and the drain port when said valve spool is in said position.

12. An output speed droop compensating control for a variable displacement pump connectable to a motor in a hydrostatic transmission; said pump having a rotatable cylinder block with a plurality of pistons, and a pivotally-mounted swash plate operatively associated with said pistons for controlling the stroke thereof and urged in one direction in response to a moment resulting from forces acting on the pistons proportional to the pressure of the fluid being pumped; a control cylinder having a piston connected to said swash plate; a control valve having a body with a port connectable to a source of fluid at a control pressure, a control port connected to said control cylinder and a port connectable to drain; a valve spool in said control valve body positionable to control communication between said ports whereby the control valve may control the position of the swash plate and apply control pressure fluid to said control cylinder to act on said piston to urge the swash plate in a direction opposite said one direction; a control for positioning said valve spool including linkages interconnecting said swash plate and valve spool; said valve spool having a bore, a pressure-sensing piston mounted on said control valve body and positioned in said valve spool bore, a passage in said valve spool connecting the exterior of the valve spool with said bore and located to communicate with said control port whereby an increase in pressure in the control cylinder resulting from the moment acting on the swash plate causes the valve spool to move in a direction to connect said control port to said control pressure port; and a spring positioned intermediate said linkage and valve spool to permit valve spool movement in response to an increase in pressure in said bore.

* * * * *